United States Patent [19]

Fry

[11] 4,235,394

[45] Nov. 25, 1980

[54] APPARATUS FOR GUIDING SUPERIMPOSED LAYERS OF LINE ONTO AND OFF OF A POWER DRIVEN REEL

[76] Inventor: Robert A. Fry, 910 Forsythe, Houston, Tex. 77073

[21] Appl. No.: 51,011

[22] Filed: Jun. 22, 1979

[51] Int. Cl.[3] ..... B65H 54/28

[52] U.S. Cl. ..... 242/158.2; 242/158.4 R

[58] Field of Search ..... 242/158 R, 158 B, 158 F, 242/158.2, 158.4 R, 158.4 A, 25 R

[56] References Cited

U.S. PATENT DOCUMENTS

| | | | |
|---|---|---|---|
| 2,757,884 | 8/1956 | Bryant et al. | 242/158 R |
| 2,900,145 | 8/1959 | Hanson | 242/158.2 |
| 3,507,458 | 4/1970 | Merchant et al. | 242/158.4 R |
| 3,779,480 | 12/1973 | Cambou | 242/158 R |
| 3,814,348 | 6/1974 | Johnson | 242/158 R |
| 3,979,084 | 9/1976 | Ruhl et al. | 242/158 F |
| 4,086,472 | 4/1978 | Sikora | 242/158 R X |
| 4,093,146 | 6/1978 | Haley | 242/158.2 |
| 4,150,801 | 4/1979 | Ikegami et al. | 242/158.2 X |

FOREIGN PATENT DOCUMENTS

| | | | |
|---|---|---|---|
| 228435 | 7/1963 | Austria | 242/158.2 |
| 1328542 | 8/1973 | United Kingdom | 242/158.2 |

*Primary Examiner*—Stanley N. Gilreath
*Attorney, Agent, or Firm*—Marvin B. Eickenroht; Jennings B. Thompson

[57] ABSTRACT

There is disclosed a means mounted in front of a power driven reel for shifting laterally back and forth in a direction parallel to the axis of the reel in order to guide a line onto or off of the reel. A servo-mechanism is provided for causing the line to be wound onto or off of the reel in accordance with a predetermined pattern and thus in an even manner.

10 Claims, 2 Drawing Figures

Figure 1:
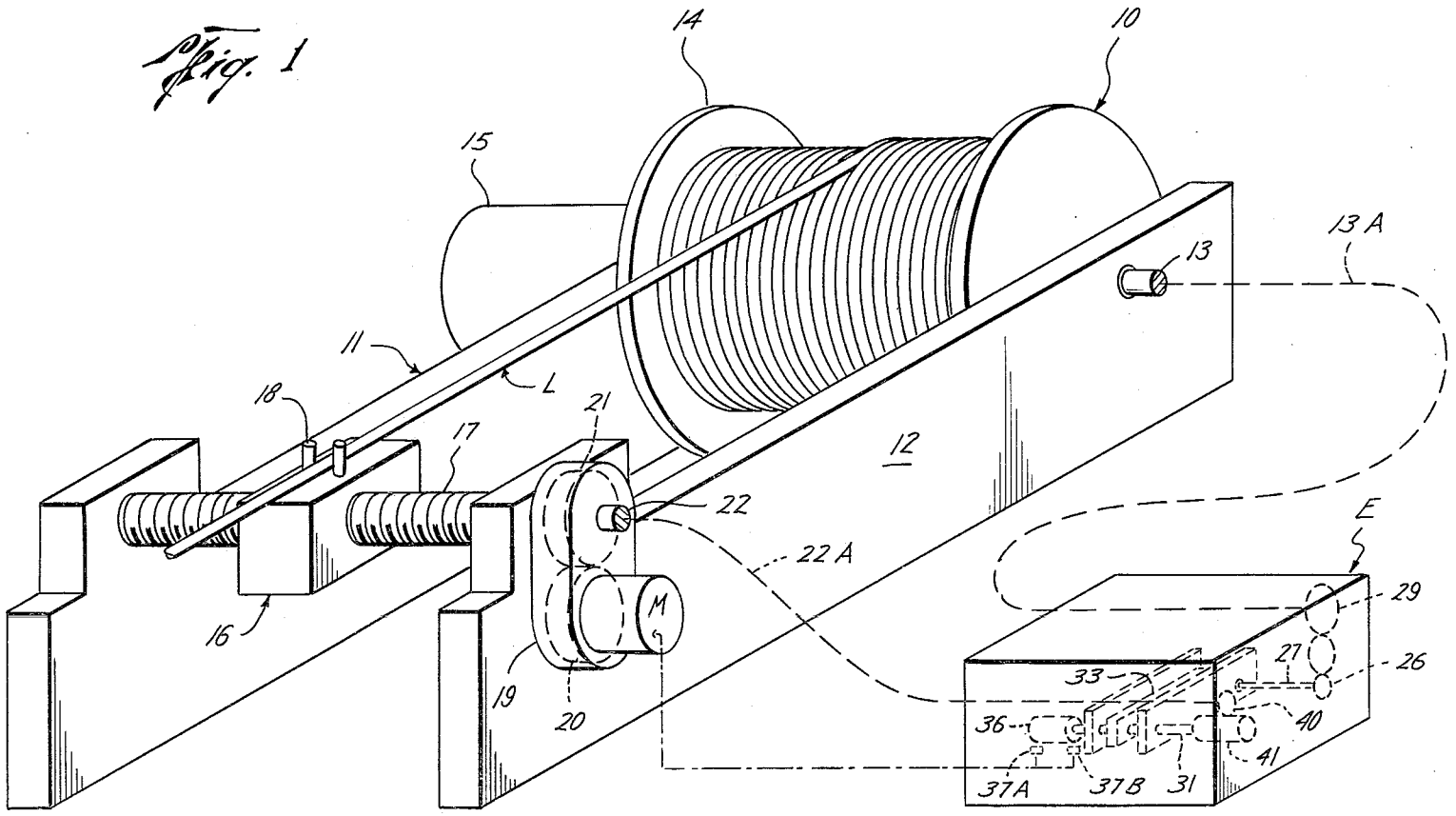

APPARATUS FOR GUIDING SUPERIMPOSED LAYERS OF LINE ONTO AND OFF OF A POWER DRIVEN REEL

This invention relates generally to apparatus for guiding superimposed layers of line onto and off of a power driven reel. More particularly, it relates to improvements in apparatus of this type having means mounted in front of the reel for shifting laterally back and forth in a direction parallel to the axis of the reel in order to guide the line onto or off of the reel in accordance with a predetermined pattern.

This invention contemplates that, in accordance with its broadest concepts, the line may be either metal cable or rope adapted to be wound onto or off of a reel of most any size and for a variety of purposes. However, it has particular utility in connection with apparatus for winding large diameter cable onto or off of reels for various heavy duty applications, particularly where space in front of the reel is at a premium.

It has been proposed to guide such superimposed layers of line by means of fairlead sheaves fixedly positioned in front of the reel. However, these sheaves work well only if located a substantial distance from the reel, as determined by the minimum fleet angle between the sheave and flanges on the ends of the reel. Thus, for example, with a reel 4 feet wide, the sheave must be positioned at least 80 feet in front of the reel. Obviously, therefore, these sheaves have no application in environments in which space in front of the reel is at a premium.

It has also been proposed to guide the superimposed layers of line onto a reel having grooves preformed in it, together with a counterbalanced shaft and sheave. However, apparatus of this type becomes massive when the cable is over two inches in diameter. Furthermore, the preformed grooves must be made to fit a specific cable size. Still further, the counterbalanced shaft depends on a constant tension condition which is never actually achieved in the field.

It has further been proposed to so guide the line by means mounted in front of the reel for shifting back and forth in a direction parallel to the axis of the reel. The guide means is caused to so move by screws having cross threads or double leads which are geared to the reel and which describe the pattern which the line is to follow as it is wound about or unwound from the reel. More particularly, a pawl on the guide means fits the double lead or cross thread and acts as a partial nut capable of turning so as to reverse itself at each end of the double lead. Although these devices do not require a large amount of space on the front side of the reel, they are incapable of withstanding high lateral loads which may be imposed on the pawl by the line to be guided. Also, expensive machinery is required to form the double lead or cross threads on massive screws necessary for guiding line of large diameter.

Attempts have therefore been made to operate the guide means by a servo mechanism which is not subject to the above-noted shortcomings. However, to my knowledge, these efforts have been unsuccessful due to the difficulty in synchronizing movement of the line and guide means. Thus, all such arrangements of which I am aware have involved slippage in some fashion such that the guide means either leads or lags the winding or unwinding of the line with respect to the reel.

An object of this invention is to provide apparatus of this type having a servo mechanism for causing the guide means and line to move in properly-timed relation to one another as the line is wound onto or unwound from the reel.

Another object of this invention is to provide such apparatus which may be manufactured as a part of new equipment including the reel, or if desired, may be manufactured as separate equipment adapted for use with an existing reel.

Another object of this invention is to provide such apparatus which is relatively simple and inexpensive to manufacture, and which consists of a minimum number of standard and readily available parts.

These and other objects are accomplished, in accordance with the illustrated embodiment of the present invention, by apparatus which comprises, along with the guide means, and a means for so shifting it in a lateral direction, a means responsive to rotation of the reel for initiating operation of the shifting means, and a means which is responsive to shifting of the guide means for interrupting operation of the guide means when it has been moved to a position which it should occupy in order to cause the line to move laterally of the reel in accordance with a predetermined pattern. The initiation and interruption of the operation of the shifting means is repeated as the reel continues to rotate in order to cause the line to be continuously wound or unwound in an even manner.

Thus, a means is provided for sensing the speed and rotation of the reel as the line is wound thereon or unwound therefrom, together with a means for predetermining the pattern which the line should follow in moving laterally of the reel in response to rotation of the reel. As a consequence, the line is not only wound or unwound evenly, but also controlled insofar as its direction laterally with respect to the axis of the reel is concerned. That is, the pattern may be designed to cause the line to follow a spiral path about the reel, or, if desired, to follow a path which is perpendicular to the axis of the reel except for lateral offsets each half diameter of the reel.

In the preferred embodiment of the invention, the servo-mechanism includes a screw which is held against axial movement and which has a double lead thread thereabout which defines the pattern which the line is to follow as it moves laterally of the reel. The double lead screw is connected to the reel for rotating in response to rotation of the reel, and a means is connected to the double lead screw for following the double lead screw as the double lead screw is so rotated. The means for initiating operation of the shifting means responds to movement of the following means, and the guide means is connected to the following means for moving the following means to a position for interrupting operation of the shifting means, as above described.

The following means comprises a screw which is mounted for axial reciprocation as well as rotation about its axis, and a means connects the double lead screw to the following screw for moving the following screw in an axial direction in response to rotation of the double lead screw. More particularly, the connection of the following screw to the guide means causes the following screw to rotate and thereby move laterally with respect to the moving means in response to movement of the guide means.

As illustrated, the reel is connected to the double lead screw by means of a gear on the double lead screw which is driven by a gear rotatable in response to rotation of the reel. Also, the guide means is connected to the following screw by a gear on the following screw which is driven by a gear rotatable in response to operation of the shifting means. Thus, both driving gears may be driven by means of a flexible shaft to facilitate disposal of the servo-mechanism in most any location with respect to the reel and guide means. More particularly, the following screw is mounted for reciprocation and rotation with respect to an axis parallel to the axis of rotation of the double lead screw, and the means connecting the screws comprises a double nut.

Preferably, the means for initiating and interrupting operation of the motor comprises a switch positioned to be engaged by a part on the reciprocal screw as it moves in one direction, the screw being connected to the shifting means for initiating operation thereof when the switch is engaged and interrupting operation thereof when the switch is disengaged. More particularly, in order to interrupt operation of the shifting means only when the reciprocal screw assumes a precise "null" position, another switch is positioned to be engaged by a part on the reciprocal screw as it moves in the opposite direction, such other switch also being connected to the shifting means for initiating operation thereof when such other switch is engaged and interrupting operation thereof when such other switch is disengaged. As illustrated, the shifting means is a reversible electrical motor, and the switches are electrical.

In the Drawings

Figure 2:
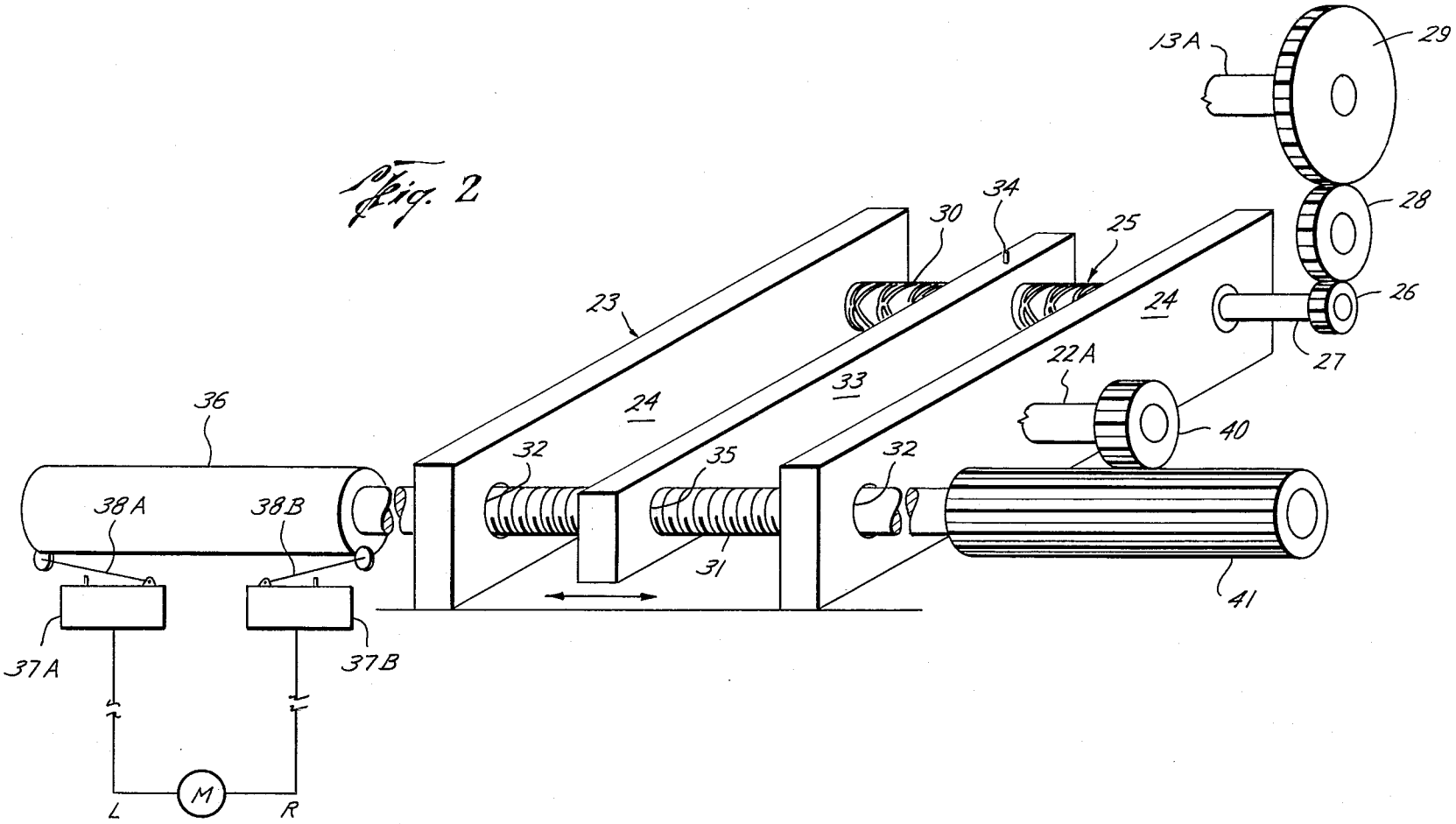

FIG. 1 is a perspective view of the above-described guide means mounted in front of a power-driven reel for causing a line to be wound upon or unwound from the reel in an even manner by shifting laterally of the reel under the control of a servo-mechanism whose parts are shown in broken lines within an enclosure to one side of the reel and guide means; and FIG. 2 is a perspective view of the servo-mechanism on an enlarged scale and with the enclosure removed therefrom.

As shown in FIG. 1, a reel 10 is mounted on a frame 11 having opposite side walls 12 which provide trunions for the opposite ends of shaft 13 extending from flanges 14 on the opposite ends of the reel. The lefthand end of shaft 13 is rotated by means of a reversible motor 15 so as to cause line L to be either wound about or unwound from the reel in superimposed layers, as illustrated in FIG. 1. Thus, upon rotation in a clockwise direction, as viewed from the right, the motor will wind the line about the reel, and, upon rotation in a counterclockwise direction, it will permit the line to be unwound therefrom.

The guide means mounted in front of the reel comprises a nut 16 threadedly connected to a screw 17 which extends parallel to the axis of rotation of the reel. The opposite ends of the screw are rotatably mounted in bearings (not shown) carried within the forwardly extending ends of the side walls 12 of frame 11. As shown in FIG. 1, pins 18 are carried on the top side of nut 16 and spaced apart a distance to closely receive line L and thereby guide it onto the reel 10. Since the line is taut and bears on the top side of the nut, rotation of the screw 17 will cause the nut 16 to be moved along its length and thus laterally with respect to the reel. More particularly, the screw is rotatable in opposite directions, so that depending on its lead, rotation in one directional sense will move nut 16 to the left, while rotation in the opposite directional sense will move nut 16 to the right.

Screw 17 is rotated by means of reversible electrical motor M mounted on a case 19 on one of the sides 12 of the frame. The motor rotates a gear 20 which in turn rotates a gear 21 fixed to a shaft 22 extending from the righthand end of screw 17. Both gears 20 and 21 are contained within the case.

As illustrated by the broken lines of FIG. 1, reel shaft 13 and screw shaft 22 are connected to parts of the servo-mechanism (to be described) by means indicated diagrammatically at 13A and 22A, respectively. For this purpose, and as previously mentioned, each such connection may comprise a flexible shaft which permits enclosure E to be located in any one of a wide variety of locations. Motor M is of course connected to other parts of the mechanism by suitable wiring, as also diagrammatically illustrated in FIG. 1.

Although, as above described and as shown in the drawings, the guide means and its associated parts are a part of the reel, it will be understood that, as previously mentioned, they may be manufactured as separate equipment for assembly and connection with an existing reel.

As shown in FIG. 2, the servo-mechanism comprises a frame 23 having side walls 24 fixed within enclosure E in any suitable manner. A screw 25 has its opposite ends rotatably mounted within journals provided by the side members 24, but fixed against reciprocation with respect to its axis, and thus held against movement laterally with respect to the frame. A gear 26 is fixed to an outward extension 27 of the screw 25, and this gear 26 is driven, through a idler gear 28, by means of a gear 29 connected to shaft 13A. Thus, the gears and connecting shafts sense the speed and direction of rotation of the reel and transmit them to the screw 25.

As shown, screw 25 has a double lead thread 30 formed along the length thereof, which, as well known in the art, consists of two threads having leads of opposite direction so as to cross one another throughout their lengths. The ends of the leads at opposite ends of the screw 25 are connected to one another so as to provide a continuous thread pattern which, if followed, moves laterally back and forth with respect to the screw 25.

The double lead determines the pattern which the line L is to follow in being evenly wound upon or unwound from the reel 10. In this case, the line is wound in a spiral pattern with successive rows of superimposed layers of the line crossing one another. In the event the screw 25 were geared to the reel on a 1:1 ratio, the double thread 20 formed therein would be an exact simulation of the path line L is to follow—i.e., the turns of the thread would be related 1:1 to the turns of the line on the reel. However, since in the illustrated embodiment of the invention, screw 25 has been geared down with respect to the reel, the turns of the thread bear less than a 1:1 ratio to the turns of the reel. In any event, due to idler, double lead is rotated in same direction as reel and at a speed proportional to that of the reel depending on ratio of double lead to desired reel wrap.

As will be understood, the double lead screw 25 is interchangeable with a similar screw whose double lead has a different pattern. Also, of course, one or more of gears 25, 26 and 28 is interchangeable with other gears to change the transmission ratio between the reel and screw 25. Thus, the apparatus is particularly well suited to changes in the pattern in which the cable is wound onto or unwound from the reel, as might be occasioned by changes in cable diameter.

Another screw 31 extends parallel to double lead screw 25 toward the forward end of frame 24. More particularly, the opposite ends of screw 31 are extended through enlarged holes 32 in side members 24 of the frame so that the screw is free to not only rotate about its axis but also to move laterally thereof.

A bar 33 disposed between and extending parallel to the side walls 24 of the frames 23 has openings at its opposite ends which receive the laterally extending screws 25 and 31. A pin 34 mounted in the top side of bar 33 fits within the double lead 30 on screw 25 so that as the screw 25 is rotated in response to rotation of the reel, bar 33 will be caused to move in a lateral direction, either to the left or to the right, as shown in FIG. 2, depending on the turn of the lead which pin 34 is following as well as the direction of rotation of the reel.

Screw 31 is threadedly received within an opening 35 through the opposite end of bar 33 so that movement of the bar 33 laterally between the opposite sides of the frame 23 causes screw 31 to be moved with it in the same direction. Thus, as will be apparent from the foregoing description, and as used in the claims of this application, bar 33 functions as a double nut, one end of which is moved in a lateral direction in response to rotation of screw 35 and the other end of which carries screw 31 with it. This lateral shifting of the following screw does not require that it be rotated, and is of course made possible by the free passage of its opposite ends through the enlarged openings 32 in the frame 23.

An enlarged cylinder 36 is mounted on the left end of lead screw 31 which extends beyond the left side member 24 of the frame 23. Switches 37A and 37B are fixedly mounted in the enclosure to dispose reed-like contacts 38A and 38B thereof in position to be engaged by opposite ends of cylinder 36 as the roller moves laterally to one side or the other of a "null" position in which both switches are in open position. Thus, as will be understood from FIG. 2, if the cylinder 36 is moved to the left an incremental distance, it will depress reed 38A of the lefthand switch 37A to thereby close switch 37A. On the other hand, lateral movement of the cylinder 36 to the right an incremental distance will depress reed 38B to close switch 37B.

As shown, each of the switches 37A and 37B is electrically connected to the motor M which has been described and shown in FIG. 1 as being mounted on frame 12 to provide the means for rotating the screw 17 and thus shifting guide means laterally of the reel. As previously described, reversible motor M is capable of rotating screw 17 of the level wind device in either direction depending on which switch is closed. Thus, actuation of switch 37A will cause the motor to rotate in one direction, while actuation of switch 37B will cause it to rotate in the opposite direction. Of course, when cylinder 36 is in its null position, and both switches are in their normally open position, the motor is stopped and rotation of screw 17 is interrupted.

Summarizing the operation of the servo-mechanism to the extent it has been above described, with line L being wound upon reel 10 so that its successive wraps are moving from right to left, as shown in FIG. 1, double nut 33 will also be moving from right to left with respect to the screw 25. That is, due to the gears 26, 28 and 29, screw 25, like the reel 10, will be rotating in a clockwise direction as seen from the right. Thus, with pin 34 following the righthand extent of the double lead thread 30, double nut 33 will move in the same lateral direction to occupy a position which is predetermined by the pattern of the double lead to be the position which the guide means should occupy in order to cause the line to be wound evenly about the reel.

As previously described, this lateral movement of the double nut will move following screw 31 to the same extent and in the same direction. This lefthand movement of lead screw 31 will cause the lefthand end of cylinder 36 to close switch 37A and thus actuate the motor M. More particularly, and as indicated by the letter "L" of FIG. 2, the motor is caused to rotate in a direction to cause the screw 17 to move nut 16 to the left.

On the other hand, if line L is instead being unwound from the reel, and follower pin 34 of double nut 33 is following the lefthand extent of the double lead 30, counterclockwise rotation of screw 25 (in response to counterclockwise rotation of the reel) will cause the double nut 33, and thus following screw 31, to move to the right. Corresponding movement of cylinder 36 to the right will thus close switch 37B to cause the motor M to rotate screw 17 in a direction to move nut 16 to the right, as indicated diagrammatically by the letter "R" in FIG. 2.

Actuation of motor M to rotate the screw 17, and thus move the guide block laterally with respect to the reel 10, is sensed by the connection 22A extending from shaft 22. The servo-mechanism includes a gear 40 which is fixed to the opposite end of drive connection 22A and in driving engagement with an elongate gear 41 connected to and rotatable with the righthand extension of lead screw 31. Thus, movement of the guide means in response to actuation of motor M is transmitted to the following screw 31, which, upon rotation, is free to be moved laterally by virtue of its threaded connection to the forward end of double nut 33.

More particularly, the arrangement is such that this movement transmitted to lead screw 31 will cause the cylinder 36 to be moved in a direction to open the switch which has been closed in order to activate motor M, thereby deenergizing the motor and momentarily discontinuing lateral movement of the guide means. For example, assuming that the lead screw 31 has been moved by double nut 33 in a lefthand direction to close switch 37A, operation of motor M in response thereto will rotate the shaft 22 and thus drive connection 22A in a direction which will, through gears 40 and 41, rotate following screw 31 in a direction which will cause it to move to the right and thus away from reed-like contact 38A.

The purpose of sensing and transmitting this movement of the guide means to cylinder 36 is of course to cause the cyliner to continually seek its null position, becuase, in this way, the position of the guide means is continually being monitored in accordance with the predetermined pattern established by double lead threads 30. As previously described, in its null position, cylinder 36 closes neither switch, and thus does not initiate operation of the motor. However, in the example above described, the incremental movement of cylinder to the right to open switch 37A may be more than needed to reach a null position. Should this occur, the righthand end of cylinder 36 will depress reed-like contact 38B and thus close switch 37B. The motor M is then again energized, but in a manner to cause it to rotate screw 17 in an opposite direction, so that the guide means is moved laterally in an opposite direction. In like manner, shaft 22 and thus drive connection 22A are rotated in opposite rotational directions, so as to rotate following screw 31 in an opposite rotational direction, and thereby cause it to move in an opposite lateral direction—namely, to the left so as to permit switch 37B to open and thus again deenergize the motor.

Because of the continuity of the double lead thread of the screw 25, the servo-mechanism functions regardless of whether the line is being reeled in or out, and regardless of the direction in which the line is moving laterally of the reel. Thus, the mechanism is extremely simple in construction and operation since it requires no additional switches or the like for sensing reversals in movement of the line, either in or out, or from one side to the other of the reel.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

The invention having been described, what is claimed is:

1. In combination with a power driven reel about which a plurality of superimposed layers of line may be wound or from which a plurality of superimposed layers of line may be unwound; apparatus comprising means mounted in front of the reel for shifting back and forth in a lateral direction parallel to the axis of the reel in order to guide the line as it is wound onto or off of the reel, means for so shifting said guide means, means responsive to rotation of the reel for initiating operation of said shifting means, and means responsive to shifting of said guide means for interrupting operation of said shifting means when said guide means has been moved to a position which it should occupy in order to cause the line to move laterally of the reel in accordance with a predetermined pattern, the initiation and interruption of the operation of the shifting means being repeated as the reel continues to rotate.

2. In combination with a power driven reel about which a plurality of superimposed layers of line may be wound or from which a plurality of superimposed layers of line may be unwound, apparatus comprising means mounted in front of the reel for shifting back and forth in a lateral direction parallel to the axis of the reel in order to guide the line as it is wound onto or off of the reel, means for so shifting the guide means, means for sensing the speed and direction of rotation of the reel as the line is wound thereon or unwound therefrom, means for predetermining the pattern which the line should follow in moving laterally of the reel in response to rotation of said reel, means for initiating operation of said shifting means in response to rotation of the reel, and means for interrupting operation of said shifting means when said guide means has been moved to a position it should occupy in order to cause the line to be moved laterally of the reel in accordance with said predetermined pattern, the initiation and interruption of the operation of the shifting means being repeated as the reel continues to rotate.

3. In combination with a power driven reel about which a plurality of superimposed layers of line may be wound or from which a plurality of superimposed layers of line may be unwound; apparatus comprising means mounted in front of the reel for shifting back and forth in a lateral direction parallel to the axis of the reel in order to guide the line as it is wound onto or off of the reel, means for so shifting said guide means, means for sensing rotation of the reel as the line is wound thereon or unwound therefrom, means responsive to such rotation of the reel for initiating operation of the shifting means in order to move said guide means laterally of the reel, means for sensing such lateral movement of the guide means, and means for interrupting operation of the shifting means when the guide means reaches a position laterally of the reel which is predetermined to be the position it should occupy in order to cause the line to wind evenly onto or off of the reel, the initiation and interruption of the operation of said shifting means being repeated as the reel continues to rotate.

4. In combination with a power driven reel about which a plurality of superimposed layers of line may be wound or from which a plurality of superimposed layers of line may be unwound; apparatus comprising means mounted in front of the reel for shifting laterally back and forth in a lateral direction parallel to the axis of the reel in order to guide the line as it is wound onto or off of the reel, means for so shifting said guie means, a screw which is held against axial movement, said screw having a double lead thread thereabout which predetermines the pattern which the line is to follow in order to wind evenly onto or off of the reel, means connecting the reel to the double lead screw for rotating said screw in response to rotation of the reel, means following the double lead thread as the double lead screw is so rotated, means for initiating operation of the shifting means in response to movement of the following means, means connecting the shifting means to the following means for moving said following means to a position to interrupt operation of said shifting means when said guide means has been moved to a position which it should occupy in order to cause the line to move laterally of the reel in accordance with said pattern, the initiation and interruption of the operation of said shifting means being repeated as the reel continues to rotate.

5. Apparatus of the character as defined in claim 4, wherein the means connecting the reel to the double lead screw comprises a gear on the double lead screw which is driven by a gear rotatable in response to rotation of the reel.

6. Apparatus of the character as defined in claim 4, wherein the following means comprises a screw mounted for lateral movement along its axis as well as rotation about its axis, a means connecting the double lead screw to the following screw for moving the following screw laterally in response to rotation of the double lead screw, and the connection of the following screw to said guide means causes the following screw to rotate and thereby move laterally with respect to said moving means in response to movement of said guide means.

7. Apparatus of the character as defined in claim 6, wherein the axis of the following screw is parallel to the axis of rotation of the double lead screw, and the means which connects the screws is a double nut.

8. Apparatus of the character as defined in claim 6, wherein the means connecting the guide means to the following screw comprises a gear on the following screw which is driven by a gear rotatable in response to operation of the shifting means.

9. Apparatus of the character as defined in claim 6, wherein the means for initiating and interrupting operation of the shifting means comprises a switch positioned to be engaged by a part of the following screw as it moves in one direction, said switch being connected to the shifting means for initiating operation thereof when the switch is engaged and interrupting operation thereof when the switch is disengaged.

10. Apparatus of the character as defined in claim 9, wherein the means for interrupting operation of the shifting means comprises another switch positioned to be engaged by a part on the following screw as it moves in the opposite direction, said other switch also being connected to the shifting means for initiating operation thereof when such other switch is engaged and interrupting operation thereof when such other switch is disengaged.

* * * * *